US006397495B1

(12) United States Patent
Doherty et al.

(10) Patent No.: US 6,397,495 B1
(45) Date of Patent: Jun. 4, 2002

(54) WEB STEERING AIR FLOTATION DEVICE FOR PRINTING EQUIPMENT

(75) Inventors: Neil Doherty, Portsmouth; Lawrence E. Zagar, Rochester, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/476,072

(22) Filed: Dec. 30, 1999

(51) Int. Cl.[7] ..... F26B 13/00

(52) U.S. Cl. ..... 34/641; 34/639; 34/640; 34/654; 34/655; 34/656; 242/615.11

(58) Field of Search ..... 34/565, 566, 571, 34/614, 615, 638, 639, 640, 641, 642, 643, 644, 654, 655, 656; 242/615.11; 226/97.3

(56) References Cited

U.S. PATENT DOCUMENTS

| | | | | | |
|---|---|---|---|---|---|
| 5,070,627 | A | * | 12/1991 | Zagar | 34/641 |
| 5,070,628 | A | * | 12/1991 | Zagar | 34/644 |
| 5,152,080 | A | | 10/1992 | Wimberger | |
| 5,156,312 | A | * | 10/1992 | Kurie | 242/615.11 |
| 5,353,979 | A | | 10/1994 | Gartmann | |
| 5,395,029 | A | * | 3/1995 | Kurie | 242/615.11 |
| 6,202,323 | B1 | * | 3/2001 | Moller | 34/631 |

* cited by examiner

*Primary Examiner*—Jiping Lu
(74) *Attorney, Agent, or Firm*—Laurence A. Greenberg; Werner H. Stemer; Gregory L. Mayback

(57) ABSTRACT

An air bar for steering a web of material has a hollow interior subjected to an air bar supply pressure. At least one air jet exit is connected to the hollow interior of the air bar. A metering device is assigned to the hollow interior of the air bar for varying the air pressured formed below the web of material for moving the web of material in a lateral direction.

27 Claims, 8 Drawing Sheets

WEB STEERING AIR FLOTATION DEVICE FOR PRINTING EQUIPMENT

BACKGROUND OF THE INVENTION

Field of the Invention

The present invention relates to a web steering air flotation device for printing equipment, particularly for guiding a web printed upon on both sides thereof, when travelling through various processing units, such as a dryer or the like.

U.S. Pat. No. 5,353,979 teaches a directing apparatus for guiding, deflecting, and/or diverting a web of material. A directing apparatus for guiding, transversely deflecting, and diverting a web of material that is guided over a number of rollers contains a block which is connected to a medium supply device for supplying a medium (i.e. air). The block has a curved surface over which the web can be led, the curved surface has a plurality of bores provided in each of separate sections forming the block. The sections extend transversely to the web, a plurality of separate sections are provided for the web of material and form a fluid bed for the web. Supply lines are provided that extend through the block and connect the separate sections to the medium supply device, whereby through the supply lines the medium can flow out of the bores and against the web from the medium supply device. Furthermore, control valves are located in the supply lines outside of the block for controlling the flow of the medium into the respective supply lines at variable velocities in variable volumes to supply a different fluid pressure to each separate section to create a pressure gradient across the webs width to deflect and divert the web from a first guided direction of travel to a second guided direction of travel depending on the pressure gradient which urges the web from the surface of the block.

U.S. Pat. No. 3,971,496 teaches a dual control adapter for a printing press, in a press having a one way clutch and a rod responsive to actuating devices for operating the clutch to control the press. There is provided a device in-between the actuating device and the rod to ensure that the press will operate only in response to a force occurring in a predetermined manner. The rod is connected to a pivotally mounted lever whose operation is first resisted and then effected by successive operation of two linkages responding to energizing of a pressure cylinder. One linkage normally provides a support function under the lever for positively preventing it from effecting movement of the rod. A pair of hand-switches are connected to a valve for energizing the cylinder when both hands of an operator are on the respective switches. With the device of the invention in place and the actuating cylinder energized, the first operation is to pull the support out of a locking position to permit downward movement of the lever. This is followed immediately by engagement of the lever by the second linkage that draws the lever downward sufficiently to affect such movement of the pull rod as to energize the clutch and initiate an operation of the press.

U.S. Pat. No. 5,152,080 teaches a steerable air apparatus. The apparatus floatingly supports a web and maintains the web in a substantially straight path as it travels through the dryer. The apparatus contains a steerable air bar assembly with one or more adjustable air bars, each having an elongated surface from which air may be discharged. The elongated surface is in an opposing relation to the running web and has two ends. Further, an air supply device in fluid communication with the air bars and an adjustment device for altering the orientation of the elongated surfaces of the adjustable air bars with respect to the running web are provided. In a preferred embodiment the orientation of the surfaces is adjusted such that each surface rotates about an axis which is substantially parallel to the longitudinal center line of the running web. The steerable air bar assembly is positioned in a web dryer such that the web is guided through the dryer in a substantially straight path. A plurality of such steerable air bar assemblies can be used in a web dryer. The dryer can also include one or more fixed air bars. Air bars can include back pressure devices for creating an opposing force to urge the web back to a substantially centered position. The back pressure device preferably has one or more edge dams preferably disposed at or near the ends of one or more fixed air bars in the web dryer.

In the technical field the need for web steering arises when webs having laterally varying tensile properties are displaced laterally while being transported through a dryer span (i.e. a static web shift). A web shift can be compensated for after traveling over the span of the dryer by commercial web guides or in the dryer span when the shift occurs. In some cases the web shift in the dryer can be too large to be corrected by the web guide.

SUMMARY OF THE INVENTION

It is accordingly an object of the invention to provide a web steering air flotation device for printing equipment that overcomes the above-mentioned disadvantages of the prior art devices of this general type, in which variations of pressure gradients across a width of the air bars assigned to a web travel plane is performed. Still further it is an object of the present invention to provide compensation for a lateral web shift of webs having laterally varying tensile properties.

With the foregoing and other objects in view there is provided, in accordance with the invention, an air bar for steering a web of material, including an air bar body having a hollow interior formed therein, the hollow interior to be subjected to an air flow providing an air pressure formed under the web of material; at least one air jet exit is connected to the hollow interior for conducting the air flow to control a lateral travel direction of the web of material; and a metering device is associated with the hollow interior and is disposed to selectively restrict the air flow through the at least one air jet exit.

The solution according to the present invention presents numerous advantages. By correcting lateral web shifts already upon passing a dryer, further web guide compensation devices can be eliminated or simplified, since large lateral deviations of the web after passage through the dryer no longer occur. Thus, upon certain applications web guides to be disposed after the exit of the dryer no longer have to be used, since web shifts are already actively compensated for in the dryer. Preferably the air bars according to the present invention are disposed above and below the web travel plane.

According to further details of the present invention, the metering devices substantially extend along the horizontal direction. The metering devices being fully integrated into the air bars. The metering devices substantially extend perpendicular to the web of material and cover an entire width of a travelling web of material.

The metering devices, which are fully integrated into the air bars allow for a movement of the metering devices with respect to air jet exits disposed on the air bar bodies. The metering devices are mounted movably to allow for a relative movement of the metering devices relative to the air jet exits or orifices that are in fixed location on the air bars.

In an alternative embodiment, upon a rotational movement of the metering device in a first direction (i.e. clockwise) about the pivot point, a degree of coincidence between the apertures tends to increase on one side of the air bar while decreasing on the other side of the air bar, thus increasing the air flow rate on one side and decreasing the air flow rate on the other side through the air jet exits. With this difference in the air flow rates and the resulting pressure gradients, the web of material is shifted in the lateral direction (perpendicular to the travel direction). On the other hand, upon a rotational movement of the metering devices in a second direction (i.e. counter clockwise) about the pivot point, the degree of coincidence between the apertures tend to decrease the air flow rate on one side and increase the air flow rate on the other side of the air exit jets thus shifting the web of material in a lateral direction opposite to that of the first rotational movement.

In the present invention there is disclosed a still further embodiment in which the metering device moves about a pivot axis, to vary slots formed between the edges of the metering device itself and adjacent walls of an air bar body that feed the air jet exits. With respect to the movements of the metering device, adjustment elements are provided to vary the shape of the slots formed between the metering device and the walls of the air bar body. In this manner, the air flow rate is controlled through the air jet exits as a whole and also in regards to each side of the air jet exits for causing a lateral shift in the web of material.

In a still further embodiment, on top of the air bars, spacing bodies are disposed across the width of the web of material for spacing the air jet exits from one another. Air exchange openings (apertures) and control ports are disposed on the metering device allowing for variations of the cushion pressure formed below the web of material travelling in a web travel plane. For adjustment purposes, the control ports are provided for aligning with the apertures for controlling an air flow into an exhaust channel formed in the air bar. The control ports can be manually, mechanically or electrically actuated for controlling a movement of the control ports.

The air bars according to the present invention are intended to be used in air flotation devices for contactless conveying of web-like material or in dryers assigned to rotary printing presses.

Other features which are considered as characteristic for the invention are set forth in the appended claims.

Although the invention is illustrated and described herein as embodied in a web steering air flotation device for printing equipment, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
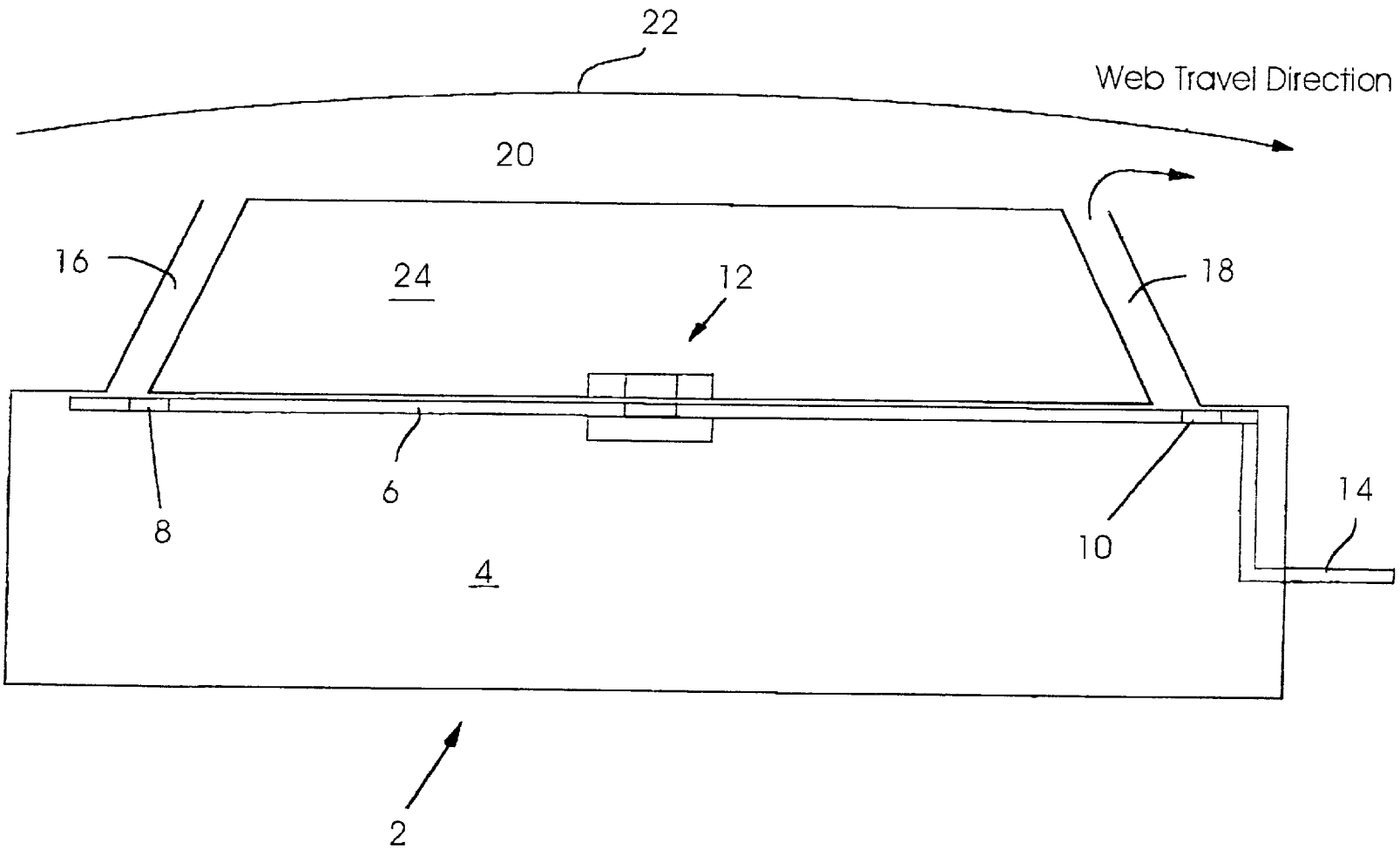
FIG. 1*a* is a diagrammatic, side sectional view of an air bar having a metering plate with metering slots assigned thereto and disposed below air jet exits according to the invention.

In all the figures of the drawing, sub-features and integral parts that correspond to one another bear the same reference symbol in each case. Referring now to the figures of the drawing in detail and first, particularly, to FIGS. 1*a* and 1*b* thereof, there is shown an air bar 2 having a metering plate 6 with metering slots 8, 10 assigned thereto disposed below air jet exits 16, 18.

The air bar 2 shown in a side, sectional view has a hollow interior 4 to which an air bar supply pressure is applied. Above the air bar 2, a carrier 24 is disposed which spaces a first air jet exit 16 from a second air jet exit 18. The air jet exits 16, 18, respectively, may consist of continuous slots or may be embodied as a series of holes disposed adjacent to one another. The substantially horizontally extending metering plate 6 is disposed within the hollow interior 4 of the air bar 2. The metering plate 6 is movably mounted about a pivot point 12 of a wall structure encasing the hollow interior 4 of the air bar 2. An adjustment element 14 is assigned to the metering plate 6 at an edge portion thereof, allowing for relative movement of the metering plate 6 with respect to the openings of the air jet exit 16, 18, respectively. The pivot point 12 is located at a nominal center line of a processing unit, such as a dryer, through the interior of which a web of material 22 passes. By use of the adjustment element 14 which may be shaped as a lever element to be actuated manually, mechanically or electrically, the relative position of the metering plate 6 towards the air jet exit 16, 18, respectively, can be easily varied. An electric or mechanical, including hydraulic and pneumatic, drive 108 is represented in dashed lines for driving the adjusting element. As can be derived from FIGS. 1*a* and 1*b*, a pivot movement of the metering plate 6 about the pivot point 12 in a clockwise direction will decrease the respective air flow at one of the ends of the air jet exits 16, 18 and increase the respective air flow at the other ends of the air jet exits 16, 18. Whereas a pivot of the metering plate 6 in a counter-clockwise direction will result in an opposite application of the air flow to the respective ends of the air jet exits 16, 18.

Thus, an increase in the air flow rates through the ends of the air jet exits 16, 18, results in an increase of velocity of the air flow and air volume, thus a cushion pressure 20 below the travelling web of material 22 will increase on one side of the web of material 22. It should be noted that the air cushion pressure 20 below the travelling web of material 22 is shown in a side view in FIG. 1*a* and that a direction of travel of the web of material 22 is shown by the arrow at the end of the web of material 22. By use of the metering plate 6 the air jet flow rates through the air jet exits 16, 18 can be varied, thus different pressure gradients can develop for adjusting a lateral movement (perpendicular to the web travel direction) of the web of material.

Figure 1B:
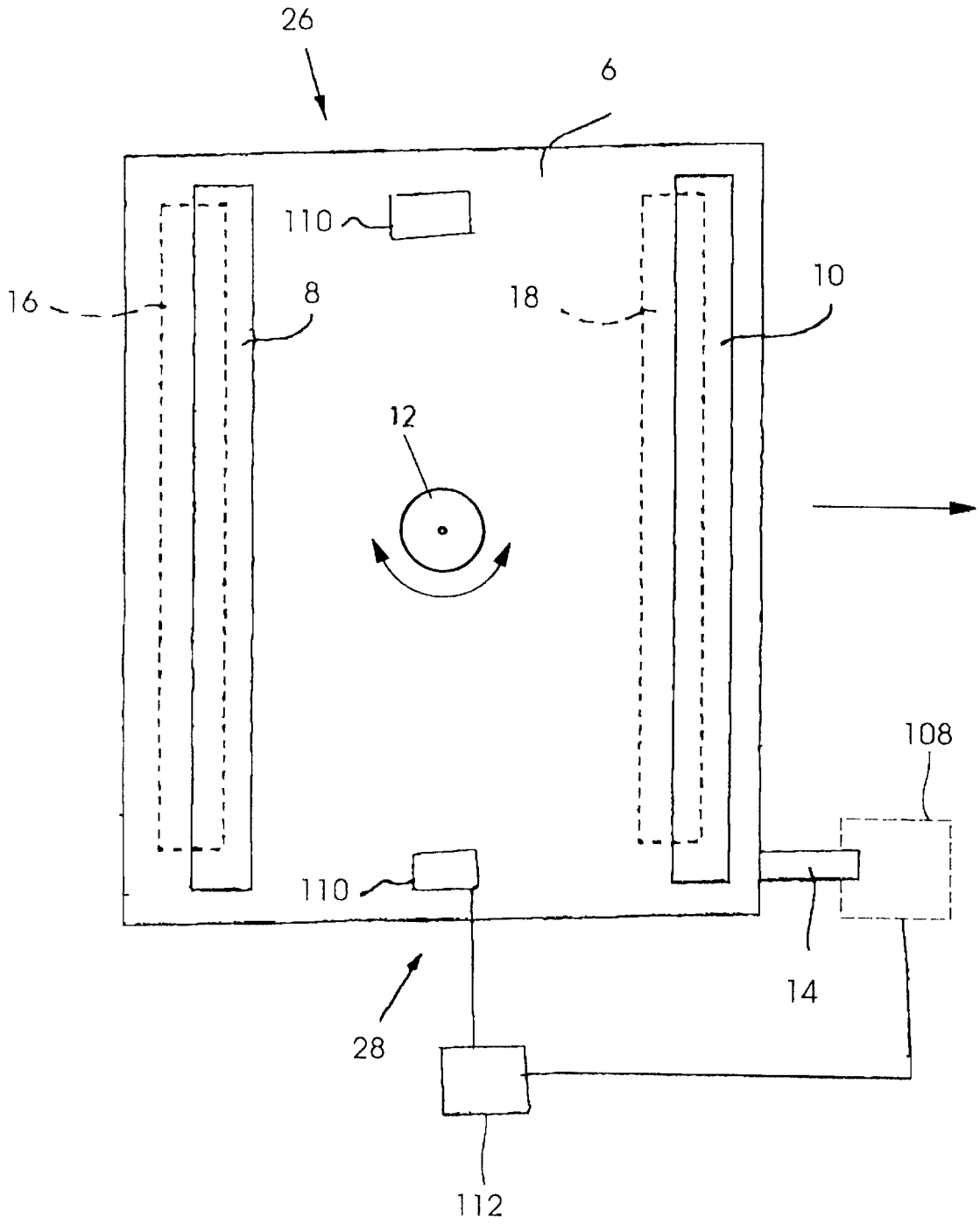
FIG. 1*b* is a top view of the air bar having the metering plate.

In FIG. 1*b* the metering plate 6 according to FIG. 1*a* is shown in greater detail.

The top plan view of the metering plate 6 given in this example shows the pivot point 12 about which the metering plate 6 can be rotated by actuating the adjustment element 14. In the example of the metering plate 6 given here, the metering slots or air exchange apertures 8, 10 extend from a gear side portion 26 of the metering plate 6 to a work side portion 28 thereof. In dashed lines, the openings of the air jet exits 16, 18, respectively, are shown which either fully coincide with the slots 8, 10 respectively of the metering plate 6 or which may be closed to a smaller or larger extent by the relative position of the metering plate 6. Respective orifices of the air jet exits 16, 18 may be shaped as continuous slots or as a series of holes. In FIG. 1*b*, the arrow represents the travel direction of the web of material 22. In this manner, as the air flow to one of the ends of the air jet exits 16, 18 increases and the air flow to the other end of the air jet exits 16, 18 decreases and vice verse, the web of material 22 is shift in the lateral direction in addition to traveling down its normal transport path.

In FIG. 1*b*, sensors 110 are provided above the carrier 24 for deriving a position of the web 22 in regards to the air bar 2. The sensors 110 are connected to a control unit 112 which is in turn is connected to the drive 108 which controls the adjustment element 14. In this manner, the positioning of the web 22 is automatically controlled.

Figure 2A:
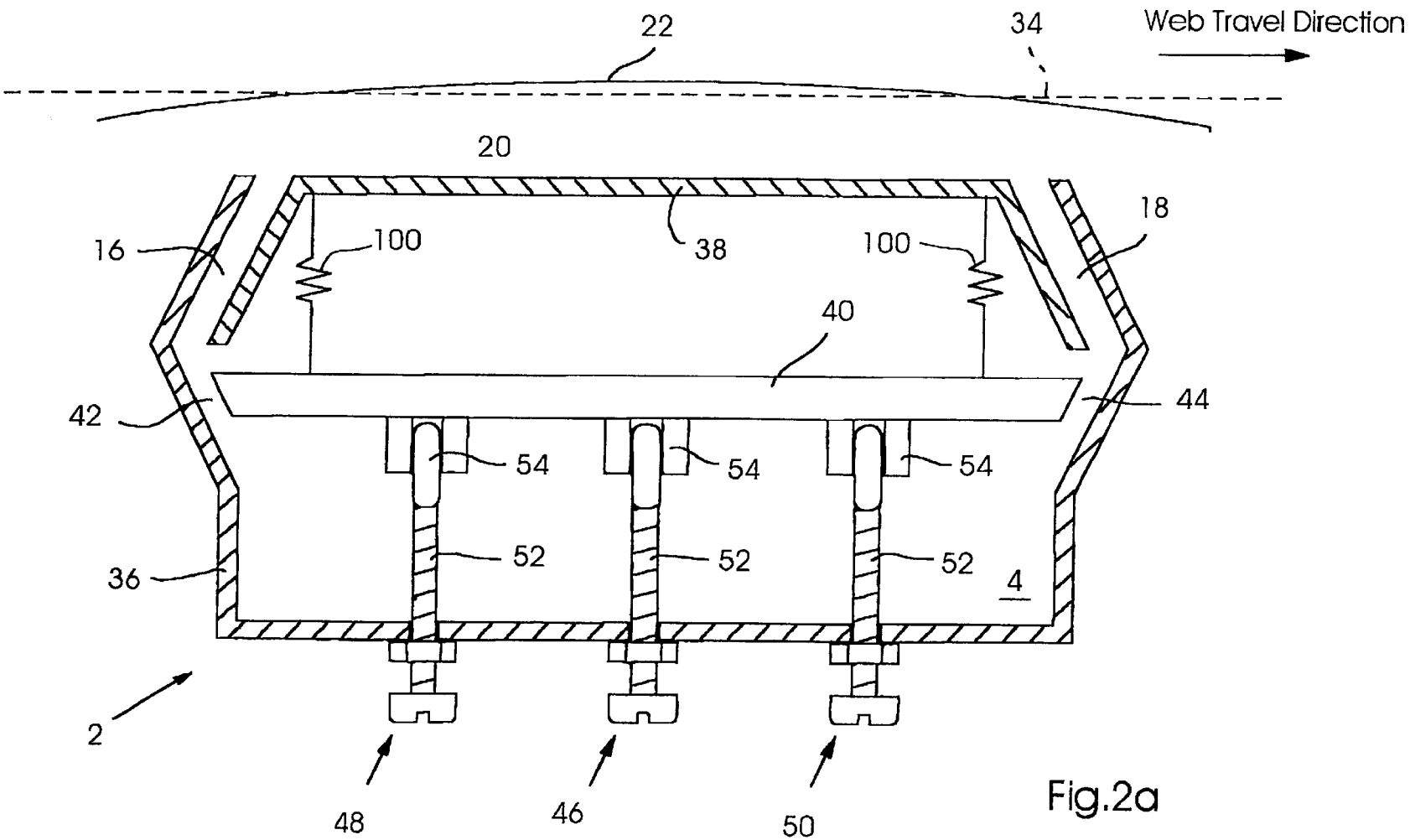
FIG. 2*a* is a side, sectional view of a metering valve adjustable about a pivot point within the air bar.
Figure 2B:
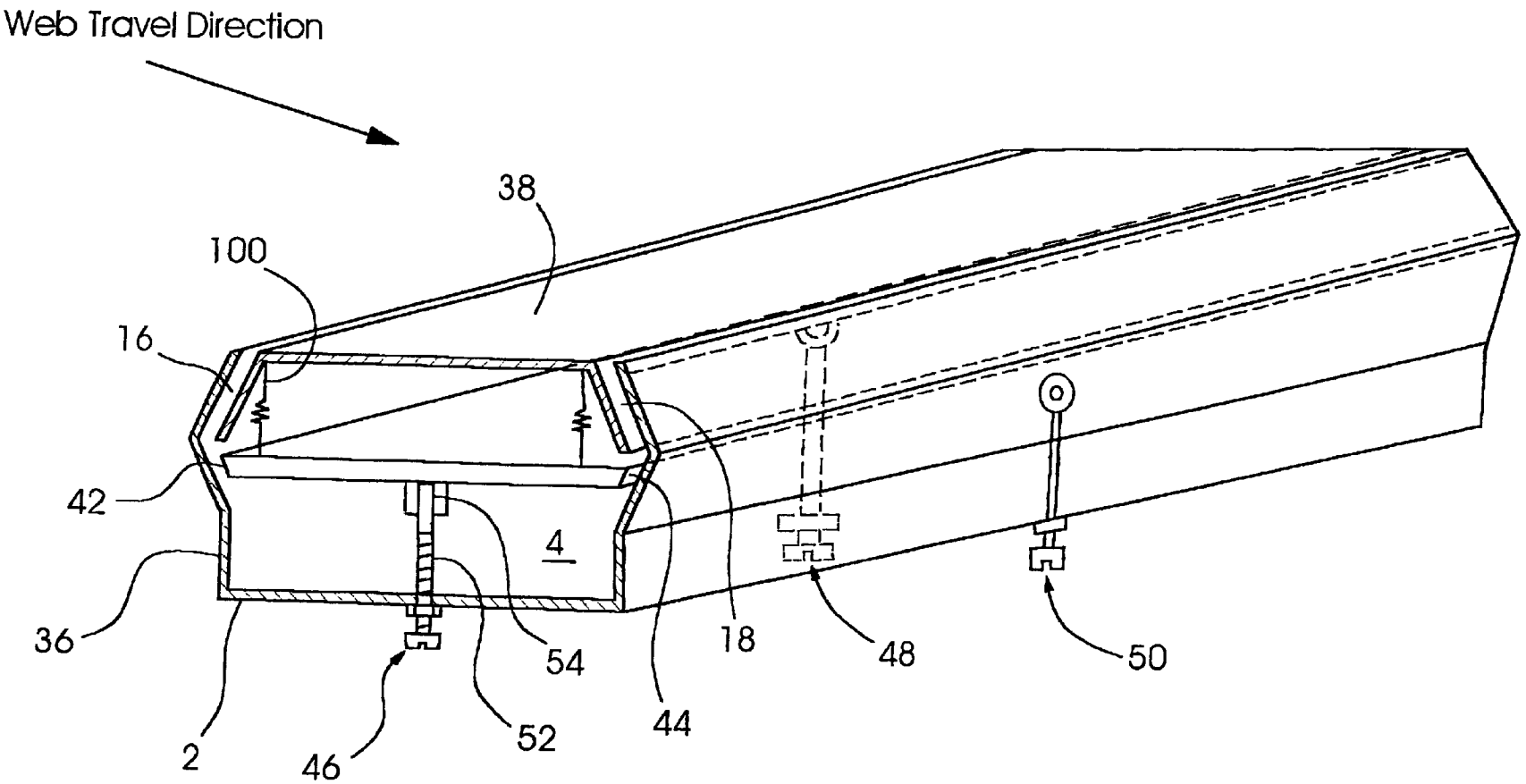
FIG. 2*b* is a partially cut-away, perspective view of the metering valve corresponding to FIG. 2*a;*

FIGS. 2*a* and 2*b* disclose a second embodiment of the invention which is formed of a metering valve 40 adjustable about a pivot point within the air bar 2.

This embodiment of the present invention likewise allows for an adjustment of the air flow rate through the respective air jet exits 16, 18. On a nominal center line of a web processing line, such as a dryer, the air bar 2 having an air bar body 36 is provided. The air bar body 36 has the hollow interior 4 to which the air bar supply pressure is applied. Within the hollow interior 4 of the air bar 2 the metering valve 40 is disposed. Above the metering valve 40 a carrier body 38 is mounted spacing the air jet exits 16, 18 respectively from one another and is attached to the metering valve 40 via bellows 100. Above the carrier 38 and the air jet exits 16, 18 the web of material 22 is shown below which the cushion pressure 20 is indicated. In dashed lines, a web deflection plane 34 is indicated. The air jet exits 16, 18, respectively, are provided between outer wall portions of the air bar body 36 and inclined lateral portions of the carrier body 38. Edge portions of the metering valve 40 are disposed opposite to respective wall sections of the air bar body 36, thus defining the air jet openings 16, 18 between the respective lateral edges and the respective wall sections.

At the respective nominal center line of the air bar body 36 a pivot point and a nominal metering valve adjustment 46 is disposed at one end of the air bar body 36 (see FIG. 2*b*). The metering adjustment valve 46 allows for movement of the metering valve 40 such that one end of the metering valve 40 is raised or lowered in comparison to the other end of the metering valve 40. By moving the metering valve 40 downwardly inclined lateral edges thereof will move towards inclined wall portions of the air bar body 36, thus decreasing air metering slots 42, 44 on one end of the air bar 2. By an upward or downward directed movement of the metering valve 40 the air flow rates passing through the metering slots 42, 44 can be adjusted in regards to the ends of the metering slots 42, 44. Furthermore, the embodiment depicted in FIGS. 2*a* and 2*b* allows for an inclination of the metering valve 40 by turning the first adjustment element 48 into an upward direction and the second adjustment element 50 into a downward direction. Consequently, the metering valve 40 tends to move about its central fixation, thus opening one metering slot 42 to a larger extent than its corresponding counter part on the opposite, the metering slot 44. Thus, different air flow rates can be easily created in the first air jet exit 16 and the second air jet exit 18, respectively.

The first and second adjustment elements 48, 50, respectively given here for example, each contain a rod shaped member 52, being connected to the metering valve 40 by respective mounting devices 54. Actuation of the central adjustment element 46 and its adjacent adjustment elements 48, 50, allowing for an inclination of the metering valve 40, can be performed manually by knobs or other types of adjustment devices. To each of the respective adjustment elements 46, 48, 50 electric motors or the like can be assigned for remote control thereof, to allow for presetting when processing a special paper stock or developing different pressure gradients across the width of the web of material 22 passing a dryer. The metering slots 42, 44 may have an exit portion that is shaped like a slot or may have an exit portion having a series of holes or bores assigned thereto.

Figure 3A:
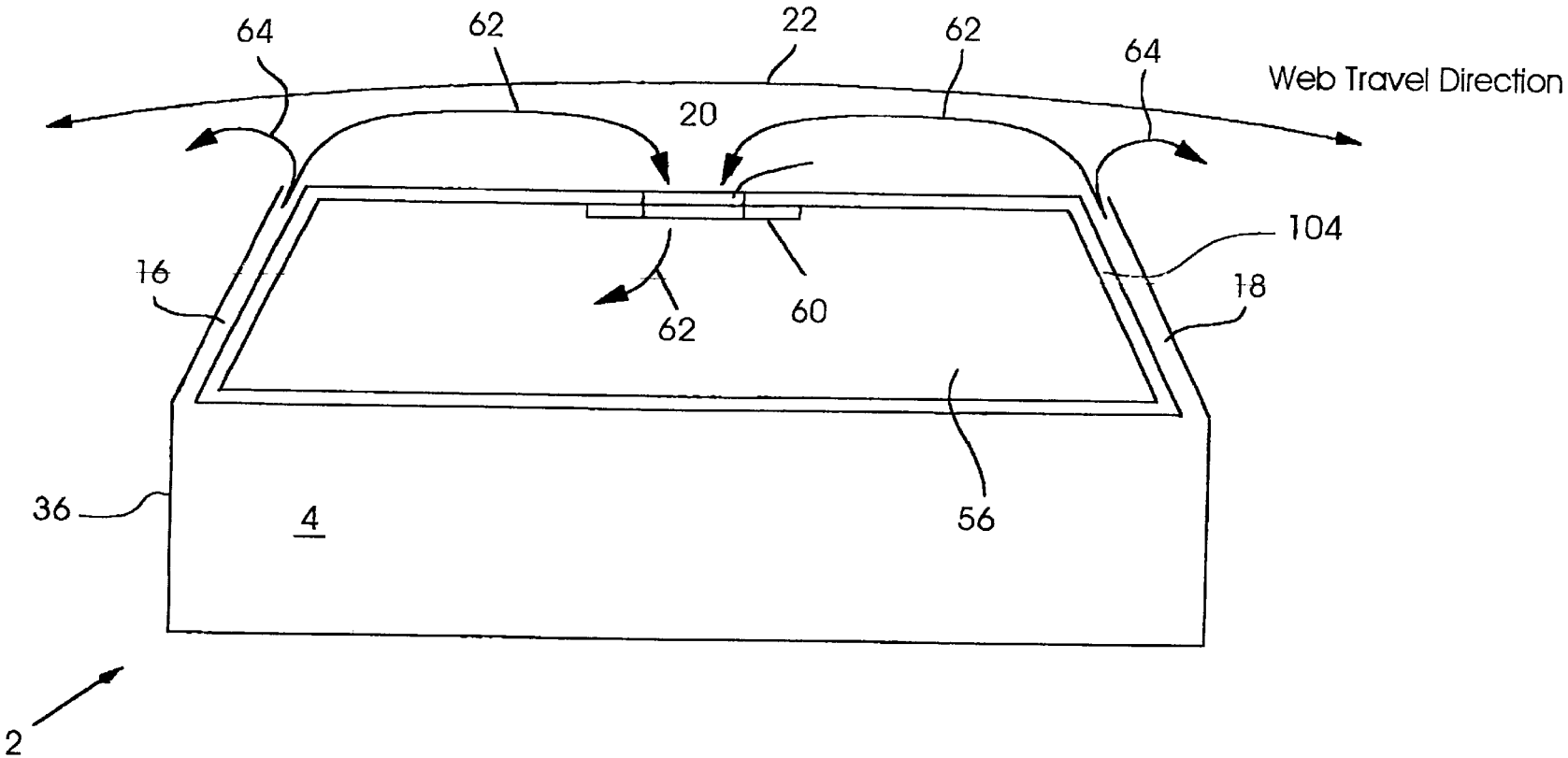
FIG. 3*a* is a side, sectional view of metered ports assigned to an exhaust channel, the metered ports having metering controls which are mounted relatively movable towards the ports.

FIG. 3*a* discloses a third embodiment of the invention which is formed of metered ports or apertures 58 assigned to an exhaust channel 56, the metered apertures 58 having port control elements 60 that are mounted to allow for relative movement towards the metered apertures 58.

In the embodiment according to FIG. 3*a* of the present invention, the air bar 2 is depicted having the hollow interior 4. The hollow interior 4 is subjected to the air supply pressure and contains the exhaust channel 56 formed in a metering body 104. Adjacent to the exhaust channel 56, the first air jet exit 16 and the second air jet exit 18 are provided, the exits of which are inclined towards the exhaust channel 56. The air jet exits 16, 18, respectively, are located between inclined wall portions of the air bar body 36 of the air bar 2 and inclined portions of the metering body 104 defining the exhaust channel 56. The cross section of the respective air jet exits 16, 18, respectively remains constant over its entire length.

In contrast to the previously described embodiments of FIGS. 1*a*–1*b*and 2*a* –2*b*, FIG. 3*a* depicts another method of varying a portion of air jet flow away from the air bar 2. In the previously discussed embodiments, the openings 8, 10 of the metering plate 6 varied the air flow to the air jet exits 16, 18 and the metering slots 42, 44 of the metering valve 40 also varied the air flow to the air jet exits 16, 18. In the embodiment according to FIG. 3*a*, the air flow to the air jet exits 16, 18 is not variable. The metering body 104 has a plurality of the metered apertures 58 having fixed sizes and disposed adjacent to one another. Below the metered apertures 58, the port control element 60 is mounted. The port control element 60 can be moved either in a sliding way or can be rotated about the pivot point 12.

As can be derived from FIG. 3*a*, the air flow exiting from the air jet exits 16, 18 below the web of material 22 either moves as an outwardly directed air jet 64 in an outward direction, thus contributing to the cushion pressure below a center portion of the web of material 22 or as an inwardly directed jet portion 62 not contributing to the respective air cushion below the web of material 22. By closing or opening the metered apertures 58 in the metering body 104 by the port control elements 60 to a larger or smaller extent, the inwardly directed air jets 62 may only leave the center portion of the cushion below the web of material 22 to a certain extent. Thus, the cushion pressure 20 created below the center portion of the web of material 22 depends on the position of the port control element 60 relative towards the fixed metered apertures 58. In this manner the web of material 22 can be displaced perpendicular to the web travel direction.

Thus, the actual position of the port control element 60 towards the fixed metered apertures 58 determines the entry of the inwardly directed air jet portions 62 into the exhaust channel 56. This in turn affects the cushion air pressure 20 below the conveyed web of material 22.

Figure 3C:
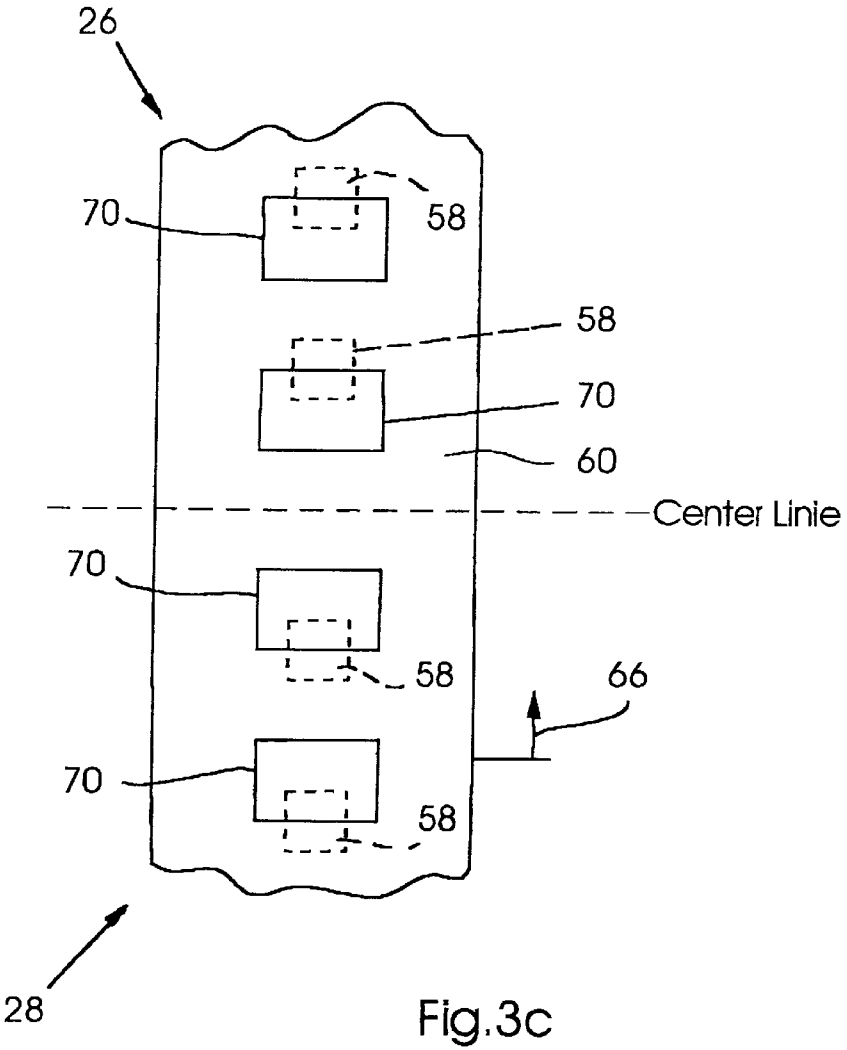
FIG. 3*c* is a fragmented, plan view of a sliding movement of the metering controls towards the fixed ports.
Figure 3B:
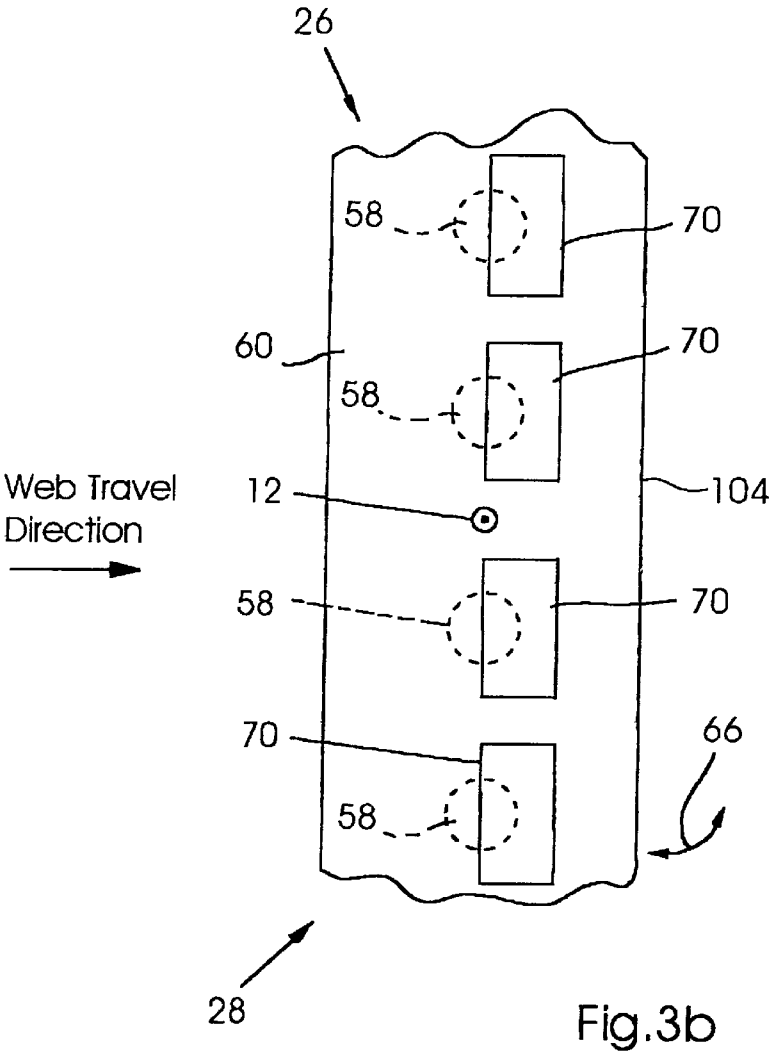
FIG. 3*b* is a fragmented, plan view of a rotational movement of the metering controls towards the fixed ports.

FIGS. 3*b* and 3*c* show in a plan view the port control element 60 in a larger scale, both for a rotational movement (FIG. 3*b*) and a sliding movement (FIG. 3*c*) thereof.

In FIG. 3*b* the port control element 60 is given, which is pivotable about the pivot point 12. A rotational movement of the port control element 60 is indicated by a double headed arrow 66. In FIG. 3*b*, the fixed size metered apertures 58 leading into the exhaust channel 56 are of circular shape, whereas apertures 70 which are orifices formed in the port control meter 60 are of a rectangular shape. By having a circular orifice 58 cooperating with the rectangular shaped orifice 70, a gradual opening or closing, respectively of an entry into the exhaust channel 56 is achievable, without having sudden impacts upon actuation of the port control element 60. In this manner, the pressure gradient can be varied on either side of the web of material 22 resulting in a lateral movement of the web of material 22.

In FIG. 3*c*, the port control element 60 is shown suitable for a sliding movement thereof. Here, the orifices 70 within the port control element 60 are one of square shaped and rectangular shaped. The fixed sized meter apertures 58 are given here as orifices having a squared shape as well. A sliding movement of the port control element 60 is indicated by arrow 68 given in FIG. 3*c*. Both port control elements 60 shown in FIGS. 3*b* and 3*c* are oriented perpendicular to a direction of web travel, the side portions of the web depicted as the gear side 26 and the respective work side 28 of a processing unit are also shown. In this manner, the pressure gradient can be varied in regards to the ends or sides of the air bar 2 thus resulting in a lateral movement of the web of material 22.

It is noted that the drive 108, the sensors 110 and the control device 112 shown in FIG. 1*b* can be equally incorporated in the embodiments shown in FIGS. 2*a*, 2*b* and FIGS. 3*a*–3*c*.

Figure 4:
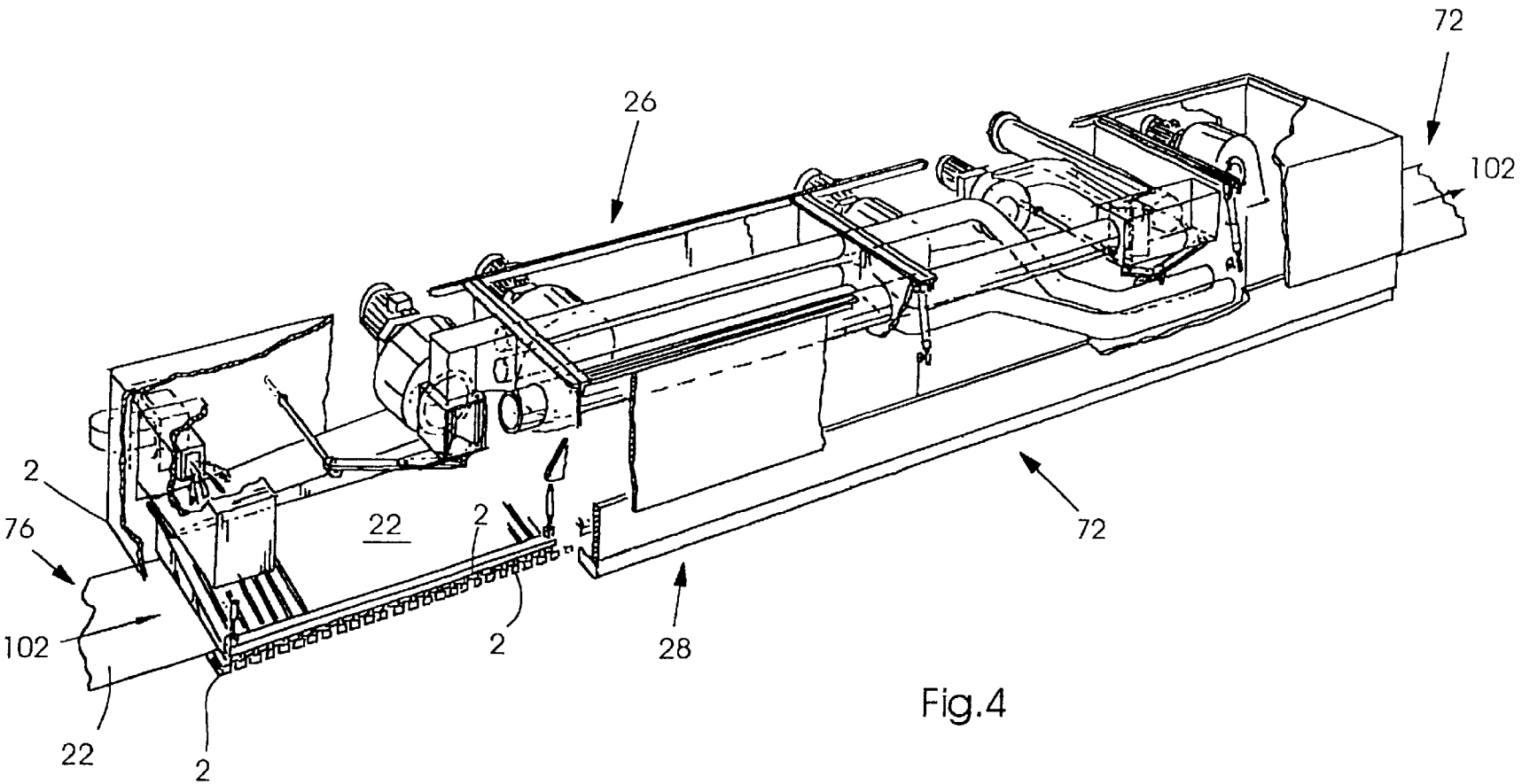
FIG. 4 is a partially broken away, perspective view of a dryer, into an interior of which the air bars are integrated above and below a web travel plane.

FIG. 4 shows a dryer 72 in a perspective view, outer walls of which are partially broken away.

The dryer 72 extends from its respective entry portion 76 to a respective exit portion 74. On the gear side 26 of the dryer 72 fans, hot air feed ducts, and a pipe system are shown partially as well as the air bars 2 according to the present invention. For example, the air bars 2 are disposed opposite to each other below and above a web travel plane 102, here shown behind the entry zone 76. A steering couple, containing an upper and a lower one of the air bars 2, may be disposed in each section of the dryer 72. Subsequent sections of the dryer 72, i.e. a heating zone, an evaporation zone, and a cooling zone may be equipped with the steering couple as shown to provide for a steering of the printed web of material 22.

Thus, a lateral web shift of the web of material 22 can be compensated for already in a processing unit such as the dryer 72, allowing for elimination of a mechanical web guide, disposed after the exit portion 74 of the dryer 72 or in the alternative to keep the lateral web shift within a certain limit to allow for compensation thereof by a mechanical web guide.

Figure 5:
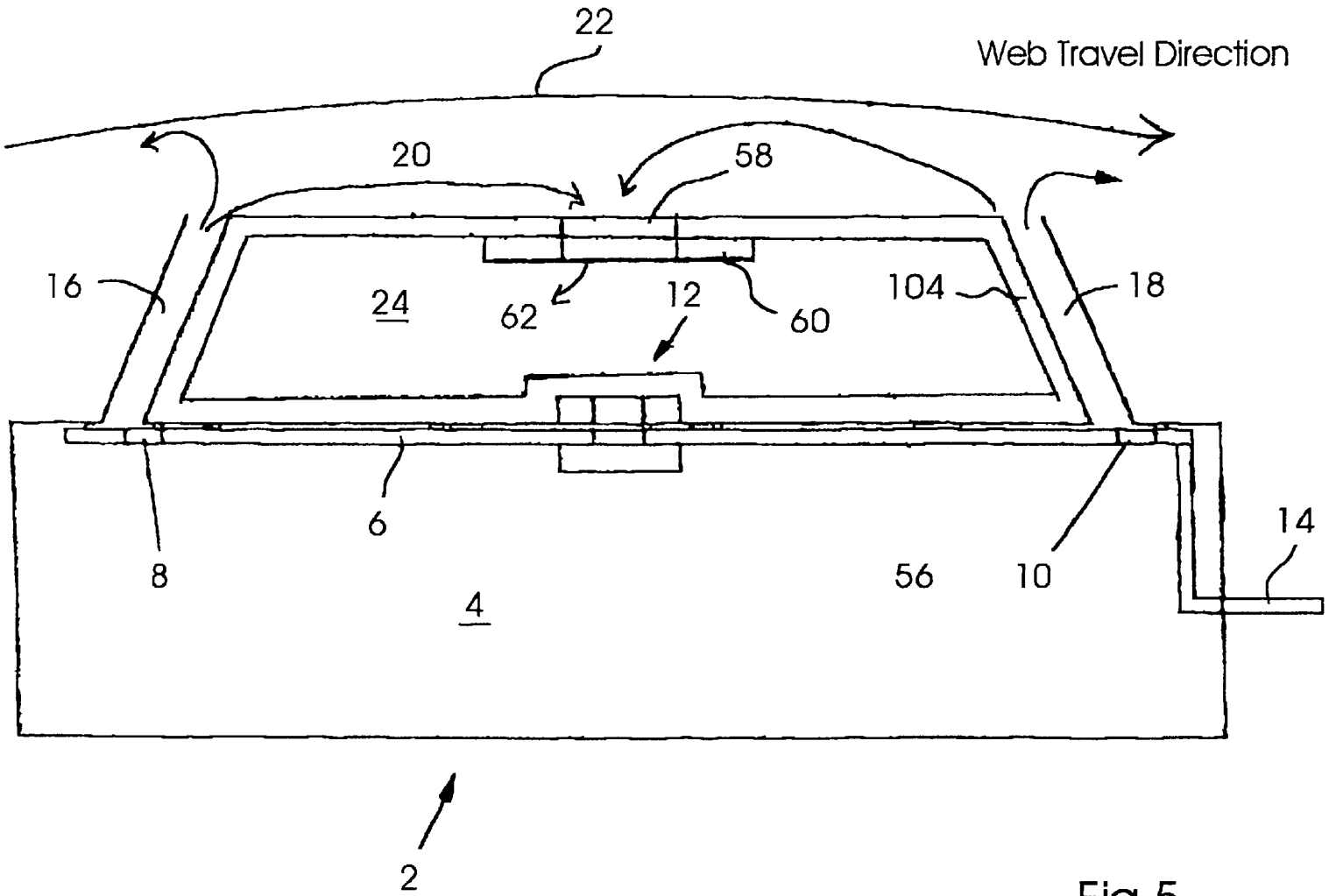
FIG. 5 is a side sectional view of the air bar having both the metering plate with metering slots assigned thereto and the metered ports assigned to the exhaust channel.

FIG. 5 shows the air bar 2 having both the metering plate 6 with the metering slots 8, 10 assigned to the air jet exits 16, 18 used in combination with the metered ports 58 having the port control elements 60 assigned to the exhaust channel 56 for controlling the lateral movement of the web 22. The air bar 2 controls the lateral adjustment of the web 22 as discussed with reference to FIGS. 1*a*, 1*b* and 3*a*–3*c* and is not reiterated here.

We claim:

1. An air bar for steering a web of material, comprising:

an air bar body having a hollow interior formed therein, said hollow interior to be subjected to an air flow providing an air pressure formed under the web of material, said air bar body having a mounting defining a pivot point;

at least one air jet exit connected to said hollow interior for conducting the air flow to control a lateral travel direction of the web of material; and a metering device associated with said hollow interior and connected to said mounting for pivoting about said pivot point, said metering device selectively restricting the air flow through said at least one air jet exit.

2. The air bar according to claim 1, wherein said metering device substantially extends in a horizontal direction.

3. The air bar according to claim 1, wherein said metering device substantially extends perpendicular to the web of material.

4. The air bar according to claim 1, wherein said metering device is disposed so as to move with respect to said at least one air jet exit.

5. The air bar according to claim 1, wherein said metering device has apertures formed therein and said at least one air jet exit is a plurality of air jet exits each with a first side and a second side, upon a rotational movement of said metering device in a first direction about said pivot point a degree of coincidence between said apertures and said plurality of air jet exits increases at said first side and decreases at said second side, thus increasing a flow rate of the air flow through said first side.

6. The air bar according to claim 5, wherein upon a rotational movement of said metering device in a second direction about said pivot point the degree of coincidence between said apertures and said plurality of air jet exits increases at said second side and decreases at said first side, thus increasing a flow rate of the air flow through said second side.

7. The air bar according to claim 5, wherein said apertures are shaped as one of holes and slots.

8. The air bar according to claim 1, wherein said metering device is disposed within said hollow interior of said air bar body mounted parallel to a web travel direction so as to define slot-shaped metering apertures formed between said metering device and said air bar body, said slot-shaped metering apertures having a first side and a second side.

9. The air bar according to claim 8, including a central adjustment element connected to said metering device and to said air bar body or moving said metering device to vary a size of said first side and said second side of each of said slot-shaped metering apertures.

10. The air bar according to claim 9, including further adjustment elements connected to said metering device on opposite sides and to said air bar body, said further adjustment elements varying a size of said slot-shaped metering apertures for controlling the air flow through said slot-shaped metering apertures.

11. The air bar according to claim 10, wherein said central adjustment element and said further adjustment elements have a pivotal mounting disposed on said air bar body for pivotally mounting said metering device with respect to said slot-shaped metering apertures.

12. The air bar according to claim 1, wherein said at least one air jet exit is two air jet exits, and including a spacing body disposed in said air bar body for spacing said two air jet exits from one another and disposed across a width of the web of material.

13. The air bar for steering a web of material according to claim 1, further comprising:

an aperture control element having control apertures formed therein and movable mounted on said metering device for controlling the air pressure under said web of material in the lateral travel direction; and wherein said at least one air jet exit is one of a plurality of metered apertures formed in said metering device, said metering device further having a first side and a second side.

14. The air bar according to claim 13, wherein upon a sliding movement of said aperture control element a degree of coincidence between said metered apertures of said metering device and said control apertures increase on said first side and decrease on said second side for increasing a flow rate of the air flow on said first side in relationship to said second side.

15. The air bar according to claim 14, wherein upon a further sliding movement of said aperture control element, a degree of coincidence between said control apertures and said metered apertures of said metering device decrease on said first side and increase on said second side of said metering device for increasing a flow rate of the air flow on said second side in relationship to said first side.

16. The air bar according to claim 15, wherein a shaped of said control apertures and said metered apertures is selected from the group consisting of squares, circles, and rectangles.

17. The air bar according to claim 13, wherein said aperture control element is pivotally mounted to said metering device about a pivot point, upon a rotational movement of said aperture control element in a first direction about said pivot point a degree of coincidence between said control apertures and said metered apertures of said metering device increases on said first side and decreases on said second side of said metering device resulting in an increase in a flow rate of the air flow on said first side in relationship to said second side.

18. The air bar according to claim 17, wherein upon a rotational movement of said aperture control element in a second direction about said pivot point, a degree of coincidence between said control apertures and said meter apertures of said metering device decreases on said first side and increases on said second side of said metering device resulting in an increase in a flow rate of the air flow on said second side in relationship to said first side.

19. The air bar according to claim 18, wherein a shaped of said control apertures and said metered apertures is selected from the group consisting of squares, circles, and rectangles.

20. The air bar according to claim 13, wherein said metered apertures of said metering device are disposed adjacent to one another and allow for varying the air pressure formed below the web of material for controlling a lateral travel direction of the web of material.

21. The air bar according to claim 1, including:

an adjustment element for adjusting a position of said metering device;

a drive unit connected to said adjustment element for adjusting said adjustment element;

sensors disposed above said air bar body, said sensors outputting sensor signals indicating a position of the web of material; and a controller receiving said sensor signals and connected to said drive unit, said controller adjusting the position of the metering device in response to said sensor signals by actuating said drive unit.

22. The air bar for steering a web of material according to claim 1, further comprising at least one further air jet exit connected to said hollow interior, said at least one air jet exit being disposed on a one side of a web center line and said at least one further air jet exit is disposed on an other side of the web center line, the air flow to said at least one air jet exit and to said at least one further air jet exit being selectively restricted.

23. The air bar for steering a web of material according to claim 22, further comprising:

a metering slot associated with said at least one air jet exit; and a further metering slot associated with said at least one further air jet exit;

wherein said metering device selectively restricts said metering slot and said further metering slot, thereby, restricting the air flow through said metering slot and said further metering slot.

24. The air bar for steering a web of material according to claim 23, wherein said metering device selectively restricts said metering slot and said further metering slot such that the air flow through said metering slot increases while the air flow through said further metering slot decreases.

25. The air bar for steering a web of material according to claim 22, wherein said metering device selectively restricts said metering slot and said further metering slot through a sliding movement.

26. An air flotation device for steering a web of material including:

an air bar body having a hollow interior formed therein, said hollow interior to be subjected to an air flow providing an air pressure formed below the web of material, said air bar body having a mounting defining a pivot point;

at least one air jet exit connected to said hollow interior for conducting the air flow to control a lateral travel direction of the web of material; and a metering device associated with said hollow interior and connected to said mounting for pivoting about said pivot point, said metering device selectively restricting the air flow through said at least one air jet exit.

27. A dryer, including:

an air bar body having a hollow interior formed therein, said hollow interior to be subjected to an air flow providing an air pressure formed below a web of material traversing said air bar body, said air bar body having a mounting defining a pivot point;

at least one air jet exit connected to said hollow interior for conducting the air flow to control a lateral travel direction of the web of material; and a metering device associated with said hollow interior and connected to said mounting for pivoting about said pivot point, said metering device selectively restricting the air flow through said at least one air jet exit.

* * * * *